United States Patent [19]

Beagell

[11] Patent Number: 4,457,448

[45] Date of Patent: Jul. 3, 1984

[54] GASKETLESS WELL CASING CAP

[76] Inventor: Joseph L. Beagell, Box 10, Harpursville, N.Y. 13787

[21] Appl. No.: 477,092

[22] Filed: Mar. 21, 1983

[51] Int. Cl.[3] ..... B65D 45/00

[52] U.S. Cl. ..... 220/327; 138/89; 166/93

[58] Field of Search ..... 220/327; 138/89; 166/93

[56] References Cited

U.S. PATENT DOCUMENTS

| | | | |
|---|---|---|---|
| 2,793,699 | 5/1957 | Tubbs | 220/327 |
| 3,035,732 | 5/1962 | Baker | 220/327 |
| 4,023,699 | 5/1977 | Lien | 220/327 |
| 4,253,583 | 3/1981 | Lynch | 220/327 |

*Primary Examiner*—George T. Hall

*Attorney, Agent, or Firm*—Charles S. McGuire

[57] ABSTRACT

A cap assembly for sealing engagement with the upper end of a cylindrical steel well casing is provided in two initially separate, upper and lower sections. The lower section has a major opening therethrough for encircling the upper end of the well casing, the diameter of said opening tapering from a dimension at the lower side which is slightly larger than the diameter of the casing, to a slightly smaller diameter at the upper side. The material of the cap and dimensions of the major opening relative to the outside diameter of the well casing are such that the lower section may be manually inserted on the casing, with the latter extending completely through the major opening, whereby the lower section is in tightly sealing engagement with the casing without requiring a gasket. The upper cap section provides a cover for the lower section and includes a recessed portion bounded by a lip of continuous, closed outline extending downwardly from the lower surface of the upper section. After the lower section is engaged with the casing, the upper section is bolted thereto with the upper section lip engaging, and preferably slightly embedded in the upper surface of the lower section to seal the opening therein, and thus the end of the well casing.

8 Claims, 4 Drawing Figures

GASKETLESS WELL CASING CAP

BACKGROUND OF THE INVENTION

The present invention relates to caps for well casings and, more specifically, to a novel two-part cap assembly which seals the upper end of a well casing without the need of a gasket.

Water wells are commonly formed by drilling to an appropriate depth for receiving ground water and fitted with a cylindrical steel casing having an inside diameter of, for example, six inches. The casing normally extends at least several inches above ground level with a permanently buried water discharge connection below the frost line. Water is pumped, by a submersible pump or the like, through a drop pipe to the water discharge line.

The upper end of the casing must, of course, be closed to prevent entry of foreign matter into the well. Cap assemblies of a variety of designs are commercially available for this purpose. Those designs presently in widest use require a resilient sealing gasket between the cap and casing. The gasket can be difficult to align and install properly, often being a very time consuming operation.

It is a principal object of the present invention to provide a well cap assembly of simple and economical construction which may be very quickly and easily installed on the upper end of a cylindrical well casing.

A further object is to provide a cap assembly which effectively seals the upper end of a well casing without requiring a gasket, or other such intermediate sealing means.

Other objects will in part be obvious and in part appear hereinafter.

SUMMARY OF THE INVENTION

In accordance with the foregoing objects, the invention contemplates a well casing cap assembly provided in two sections, the lower of which sealingly engages the outer perimeter of the upper end of the cylindrical, steel well casing which is above ground level. The lower cap section has a major opening therethrough defined by a wall which is generally cylindrical, but which tapers from a diameter at the lower end which is slightly greater than the outside diameter of the well casing, to a diameter at the upper end slightly less than that of the casing. The upper diameter of the lower cap section opening relative to that of the casing, and the material of the cap, preferably ABS plastic or similar material, are such that the lower cap section may be manually inserted (with an interference fit) over the casing, which extends completely through the major opening in the lower cap section.

After the lower cap section has been so installed, with the upper end of the well casing extending, e.g., about ¼ inch above the upper surface thereof, the pump may be secured thereto by a nylon rope, or the like, and the electrical cable from the pump passed through a second opening in the lower cap section. The second opening is threaded in conventional fashion to accept a protective hollow tubing through which the electrical cable passes to the power supply.

The upper cap section is then placed in covering relation to the well casing and secured to the lower section by means of bolts passing through aligned openings in the upper and lower sections. A lip is provided on the lower surface of the upper cap section for engagement with the upper surface of the lower cap section. The lip is of continuous outline and completely encircles both openings in the lower cap section. The engagement of this lip with the upper surface of the lower cap section provides an effective seal when the two sections are bolted together, the lip preferably being slightly embedded in the lower cap section when the bolts are tightened to the maximum possible extent as governed by bosses surrounding the bolt hole openings.

DETAILED DESCRIPTION

Figure 1:
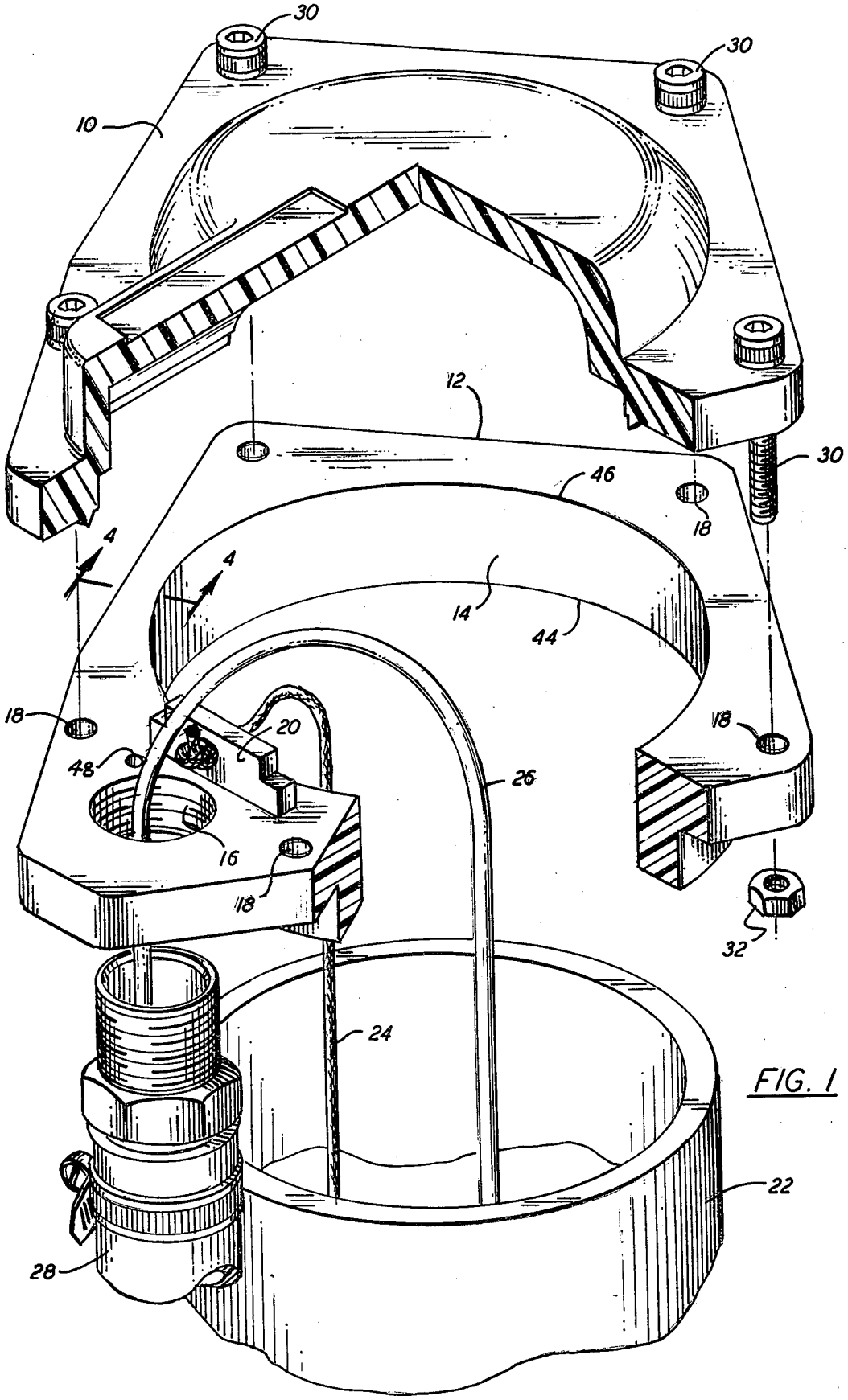
FIG. 1 is a fragmentary, exploded, perspective view of the cap assembly, the upper end of the well casing, electrical cable and conduit, etc.

Referring now to the drawings, the cap assembly of the invention is provided in two initially separate sections which, when installed, are vertically superposed and therefore termed upper and lower cap sections, denoted by reference numerals 10 and 12, respectively. Lower section 12 has a major opening, defined by smooth, generally cylindrical wall 14, extending therethrough. Adjacent and spaced from the major opening is a second opening, defined by threaded wall 16, and a plurality of additional openings, all denoted by reference numeral 18, for the passage of securing bolts, as will appear later. Portion 20 is formed as an integral part of lower section 12, extending upwardly, between the major and second openings, from the upper surface thereof.

Upper end 22 of a conventional, cylindrical well casing (above ground level), is also shown in FIG. 1, together with nylon cord or rope 24, by which a submersible electric pump (not shown) is suspended in the well, and electrical cable 26 for supplying power to the pump. The upper end of rope 24 is passed through an opening provided for such purpose in portion 20 and secured thereto, holding the pump at a desired level and permitting withdrawal thereof from the well. Cable 26 passes through hollow tubing or conduit 28 which is engaged with threaded wall 16 of the second opening in lower cap section 12.

Figure 2:
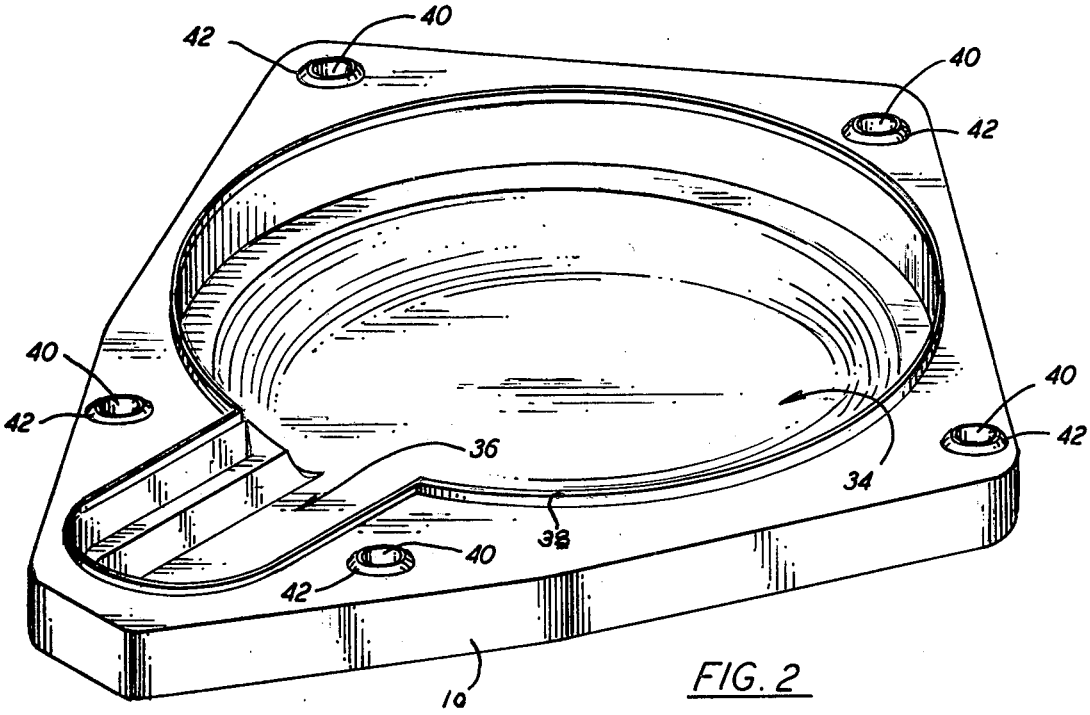
FIG. 2 is a perspective view of the lower side of the upper cap section.

Upper and lower sections 10 and 12 are of the same peripheral outline and, when fully installed, are superposed and secured tightly together by bolts 30 and nuts 32. As seen in FIG. 2, the lower side of upper cap section 10 has a central recessed portion 34 and a continuous forward recessed portion 36, such portions lying in covering relation to the major and second openings, respectively, in lower cap section 12 when the two sections are superposed and secured. Surrounding both recessed portions is continuous lip 38, integrally formed on the lower surface of upper section 10. A plurality of openings 40 are provided in upper section 10 for alignment with openings 18 in lower section 12 and passage of bolts 30. Bosses 42 are also integrally formed on the lower surface of upper section 10 surrounding each of openings 40.

Figure 3:
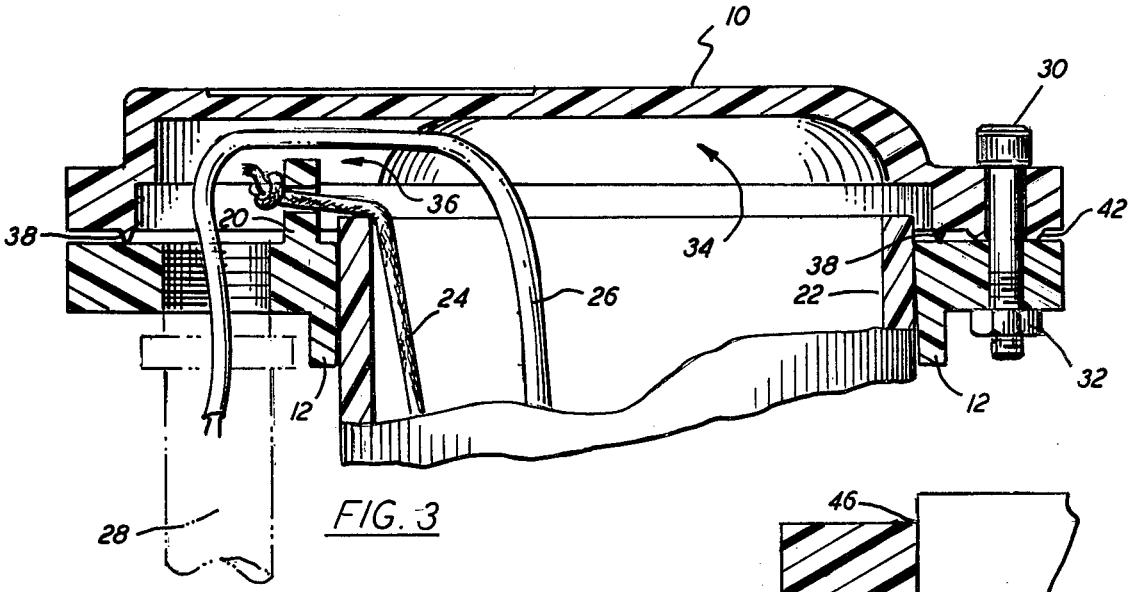
FIG. 3 is a side elevational view in vertical half-section showing the cap assembly installed on the well casing.
Figure 4:
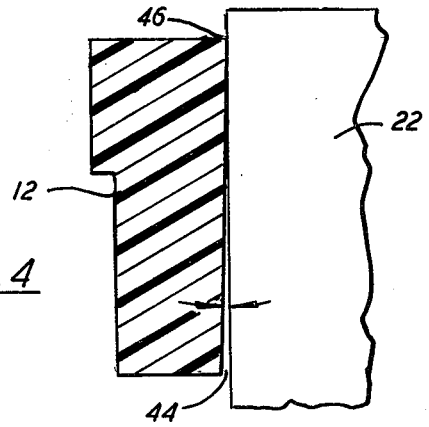
FIG. 4 is an enlarged, fragmentary, side elevational view, in section on the line 4—4 of FIG. 1, showing the lower cap section installed on the upper end of the casing.

It may be noted from FIG. 3, and more prominently from FIG. 4, that wall 14 tapers gradually from a larger diameter at its lower end 44 to a smaller diameter at its upper end 46. The diameters at the upper and lower ends of wall 14 are determined by the outside diameter of the well casing with which the assembly is to be used, a common example being 6 inch O.D. casing. The diameter at lower end 44 is made slightly larger, e.g. ⅛ inch, and the diameter at the upper end slightly smaller, e.g. 1/16 inch, than the outside diameter of the casing with which the cap is to be used. Thus, the lower section may easily be inserted over the upper end of the casing, since the larger diameter at the lower end of the lower section major opening provides a lead-in for the casing.

The cap assembly, in particular lower section 12, is of a material which is rigid, yet having some capacity for deformation, a preferred example being ABS plastic. Thus, lower section 12 may be manually forced downwardly until upper end 22 of the casing extends completely through the major opening, the interference fit at upper end 46 of the opening providing tight, sealing engagement between lower cap section 12 and upper casing end 22. Preferably, the lower section is forced downwardly until about ¼ inch of the casing extends above the upper surface.

After the pump and electric cord connections have been made as previously described, upper cap section 10 is placed upon and aligned with lower cap section 12. The edge of lip 38 lies in a flat plane slightly further from the plane of the lower surface of upper section 10 than the plane in which bosses 42 lie. That is, lip 38 is slightly higher than bosses 42 whereby, when bolts and nuts 30 and 32 are tightened to bring bosses 42 into contact with the upper surface of lower section 12, lip 38 is actually biting into or slightly embedded in such surface. Since lip 38 entirely surrounds both the major and second openings in lower section 12, this provides a virtually airtight seal with the only communication of the well with the atmosphere being through conduit 28 and any other fittings which may be provided further down the well. If desired, an additional opening 48 may be provided for such purpose through lower cap section 12, internally of the engagement therewith of lip 38. When such a vent opening is provided, a one-way check valve and screen are provided on the lower side (not shown) to prevent entry of water and foreign material carried thereby in the event outside water level rises above the installed cap.

From the foregoing it is apparent that the cap assembly of the invention effectively seals the upper end of a well casing without the use of gaskets or other intermediate sealing means. The cap assembly may be installed on the casing in a very fast and simple manner with vitrually no possibility of faulty installation destroying the desired sealing relationship. The assembly is likewise economical in fabrication, comprising only two parts, each preferably a unitary plastic casting, plus nuts and bolts.

What is claimed is:

1. A cap for installation on the upper end of a cylindrical well casing having an outer first diameter in sealing engagement therewith, said cap comprising, in combination:

(a) a lower section having a first opening therethrough bounded by a generally cylindrical surface, tapering outwardly from a second diameter at one end to a third diameter at the other end;

(b) said third diameter being larger than said first diameter and said second diameter being smaller than said first diameter by an amount permitting manual forced insertion of said lower section on said casing with said other end downward and said casing extending entirely through said lower section;

(c) said lower section having an upper surface lying in a plane normal to the axis of said opening;

(d) an upper section having a lower surface surrounding a recessed portion of predetermined outline larger than said first diameter;

(e) a lip of continuous, closed outline extending downwardly from said lower surface of said upper section and having a terminal edge lying in a substantially flat plane; and (f) means tightly joining said upper and lower sections in predetermined relation with said lip completely surrounding said first opening and in sealing engagement with said upper surface of said lower section.

2. The invention according to claim 1 wherein said lower section includes a second opening therethrough, spaced from and having an axis parallel to said first opening, said lip completely surrounding both of said first and second openings when said upper and lower sections are joined in said predetermined relation.

3. The invention according to claim 2 wherein the material from which said upper and lowr sections are formed permits said lip to imbed slightly in said upper surface of said lower section when said upper and lower sections are tightly joined.

4. The invention according to claim 3 wherein said material is ABS plastic.

5. The invention according to claim 2 wherein said means joining said sections comprises a plurality of additional openings extending through both said upper and lower sections and alignable to place said sections in said predetermined relation, a bolt extending through each of the aligned openings and tightened by a nut to tightly join said upper and lower sections.

6. The invention according to claim 5 and further including spacer means formed integrally with at least one of said upper and lower sections and positioned therebetween when said sections are tightly joined to define the extent by which said sections may be moved toward one another.

7. The invention according to claim 6 wherein said spacer means comprises bosses surrounding each of said additional openings in one of said sections.

8. The invention according to claim 7 and further including a vent opening extending through said lower section at a position between said first opening and the engagement of said lip with said upper surface of said lower section.

* * * * *